United States Patent [19]

Rice

[11] Patent Number: 4,598,862

[45] Date of Patent: Jul. 8, 1986

[54] FOAM GENERATING DEVICE AND PROCESS

[75] Inventor: Charles A. Rice, Greenville, S.C.

[73] Assignee: The Dow Chemical Company, Midland, Mich.

[21] Appl. No.: 499,294

[22] Filed: May 31, 1983

[51] Int. Cl.[4] ..... B05B 7/10; B05B 7/30

[52] U.S. Cl. ..... 239/8; 239/311; 239/343; 239/403

[58] Field of Search ..... 239/8, 10, 310, 311, 239/314, 343, 403, 427.3, 498–502; 222/190; 169/14, 15

[56] References Cited

U.S. PATENT DOCUMENTS

| | | | |
|---|---|---|---|
| 1,003,700 | 9/1911 | Busch | 239/498 |
| 2,183,561 | 12/1939 | Hamblin | 169/15 |
| 2,645,292 | 7/1953 | Williams | 169/15 |
| 2,765,856 | 10/1956 | Schultz | 169/15 |
| 3,701,482 | 10/1972 | Sachnik | 169/15 X |
| 3,784,111 | 1/1974 | Piggot | 239/427.3 |
| 3,918,647 | 11/1975 | Lamz et al. | 169/14 X |
| 3,946,947 | 3/1976 | Schneider | 239/403 X |
| 4,082,225 | 4/1978 | Haynes | 239/499 X |
| 4,463,905 | 8/1984 | Stoesser et al. | 239/329 |

*Primary Examiner*—Jeffrey V. Nase

*Attorney, Agent, or Firm*—L. E. Hessenaur, Jr.

[57] ABSTRACT

A foam generating device and unique process for generating same is provided which generates foam by passing a foamable liquid through a swirl chamber and orifice to produce a vortex spray of finely divided particles.

7 Claims, 10 Drawing Figures

FOAM GENERATING DEVICE AND PROCESS

BACKGROUND OF THE INVENTION

This invention relates generally to the art of foam production and more particularly to a nozzle construction for generating a foamed liquid and to the process for generating such a foamed liquid.

As utilized within this disclosure the term "foam," "foamed liquid" and "foaming" relate to the conversion of a liquid substance to a substantially homogeneous mixture of that liquid with a gaseous substance. Generally, the gaseous substance is air and the liquid is converted into a film-like cellular structure encompassing that air. Foam has substantially different flow properties from a liquid and is thus useful to the extent that the different flow characteristics of the foam enhance the useful features of the liquid.

A particular area where a foam has been found useful is with detergent products such as those utilized for the cleaning of vertical surfaces such as windows and household woodwork. A foam possesses an advantage in that it is more readily visible than the homogeneous liquid by itself. Additionally, a foam product tends to stabilize on a vertical surface to an extent which is significantly greater than that of a homogeneous liquid. A homogeneous liquid to the contrary rather than stabilizing tends to quickly run off a vertical surface.

Another advantage for the utilization of a foam product is in the application thereof to the surface to be cleaned. Normally such detergent products are applied by projecting a stream of a liquid product to the surface. If a vertical surface is being utilized, a homogeneous liquid applied as a spray has a propensity to bounce off the surface and generally become airborne, whereas a foamed product tends to strike the vertical surface and remain as a foam upon that surface.

Various prior art devices have been devised for the production of foam. Generally such devices relate to techniques involving the mixing of air and the product to be foamed. A great deal of effort has been utilized in the production of foam for fire extinquishing purposes. There is, thus, a large body of patent literature related to highly mechanized and automated devices for the production of large volumes of foam. For example, there are many devices of the type utilized in the aviation industry for prevention of fires upon the landing of disabled aircraft. Various other industrial devices exist which utilize automated and high pressure equipment for the generation of foam. Examples of such devices are described in U.S. Pat. Nos. 3,446,285 and 3,547,200 to Hout; U.S. Pat. No. 3,094,171 to Gagliardo; U.S. Pat. No. 2,630,183 to Foutz; U.S. Pat. No. 2,624,622 to Holte; U.S. Pat. No. 3,388,868 to Watson et al; U.S. Pat. No. 3,784,111 to Piggott; and U.S. Pat. No. 3,701,482 to Sachnik.

Various nozzles exist within the prior art for atomizing a liquid for the purpose of producing a very fine spray as opposed to a foam. Examples of such prior art devices are found in U.S. Pat. No. 3,512,719 to Phelps et al and U.S. Pat. No. 4,187,985 to Goth.

Patents particularly directed to the production of foam from liquid detergent products are described in U.S. Pat. Nos. 3,918,647 to Lamz et al; 3,946,947 to Schneider and U.S. Pat. No. 4,013,228 also to Schneider. The nozzles disclosed in the above U.S. Patents relate to adjustable nozzles which are utilized with a very high pressure drop between the liquid and the foaming nozzle tip for use with manually operated pumping devices. The foam production section of the apparatuses described in the above patents is of significant length in comparison to a manually maneuvered container for the liquid detergent product. With the existence of all of these prior art devices, however, there is no single foam producing unit which is readily adaptable to use from the standpoint of manual force required to produce a foamed product together with an aesthetic appearance of the device and the quality of the foam produced.

SUMMARY OF THE INVENTION

It is thus an object of this invention to provide a novel foam generating device utilizing a unique process for so doing.

It is a further object of this invention to provide a foam generating device which is operable at reduced pressure differentials from those utilized in the prior art to thereby facilitate manual operation of same.

It is a still further and more particular object of this invention to produce a foam generating device which is small in comparison to a manually handleable container of a liquid for use with such foaming apparatus.

These as well as other objects are accomplished by passing a foamable liquid through a swirl chamber and orifice to produce a vortex spray of finely divided particles, passing the vortex spray into a venturi opening while said vortex spray is in substantial circumferential gaseous communication with an entrainable gas whereby vortex spray entrains the available gas, not only due to the venturi action, but also due to cyclonic action from the vortex spray to thereby produce a gaseous-liquid mixture and then passing the mixture through a nozzle where the mixture emerges as a foam product. The apparatus for carrying out the foaming process comprises means defining a swirl chamber in communication with an orifice through a partition, means defining a venturi opening in communication with the orifice and a space between the partition, and the means defining the venturi opening to provide for circumferential gaseous communication to liquid flowing between the two.

DETAILED DESCRIPTION

In accordance with this invention, it has been found that a foam generating apparatus may be produced which operates to entrain a gas into a liquid utilizing not only the venturi effect utilized in prior art devices but, also, synergistically combines the effect of the cyclonic action of a vortex. The combination of the two phenomena provides for the generation of a foam product at lower pressure differentials than heretofore utilized, and provides for a novel foam generating apparatus which is significantly smaller and of shorter path than any such apparatus heretofore produced. Various other advantages will be apparent from the following description with reference to the various figures of drawing.

Figure 1:
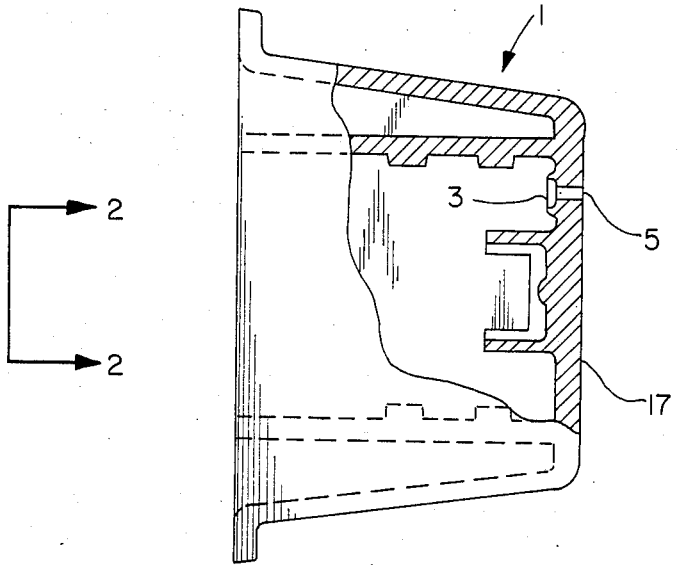
FIG. 1 of the drawings represents a spray nozzle having means defining a swirl chamber therein.
Figure 2:
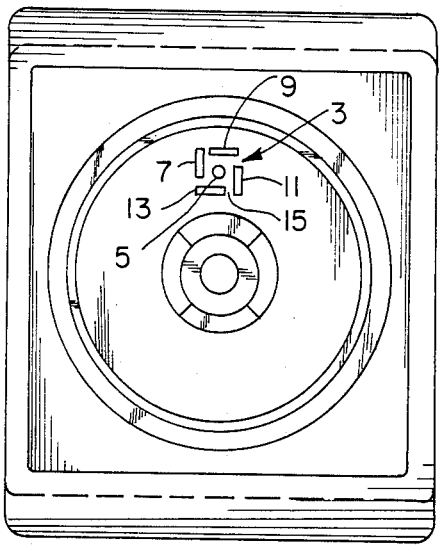
FIG. 2 is a view along the line 2—2 of FIG. 1.

FIG. 1 of the drawings illustrates a spray nozzle 1 which is adapted to communicate with a manually operable pump such as the type described in U.S. Pat. No. 3,749,290 to Micallef which is hereby incorporated by reference. The spray nozzle 1 comprises means defining a swirl chamber 3 in communication with an orifice 5. The swirl chamber 3 may be better understood by referring to FIG. 2 of the drawings which is taken along line 2—2 of FIG. 1. Means defining a swirl chamber 3 comprises, preferably, a plurality of offset veins 7, 9, 11 and 13. The offset veins define at the point of offset a plurality of liquid passageways, one of which is identified here as 15, so when liquid flows through the four passageways illustrated in FIG. 2, a liquid swirl is created which flows toward and enters orifice 5. Referring again to FIG. 1, it can be seen that orifice 5 is defined by a partition 17 such that the swirling liquid passes from swirl chamber 3 through orifice 5 to emerge on the opposite side thereof as a swirling vortex.

For purpose of understanding it should be noted that swirl chamber 3, when a spray nozzle 1 is in communication with a pump, is covered such that liquid communication only occurs through the passageways 15 between adjacent veins 7, 9, 11 and 13. It is understood, however, that this is merely a preferred construction and that other configurations may be utilized so long as a swirl of fine mist emerges through orifice 5.

Figure 3:
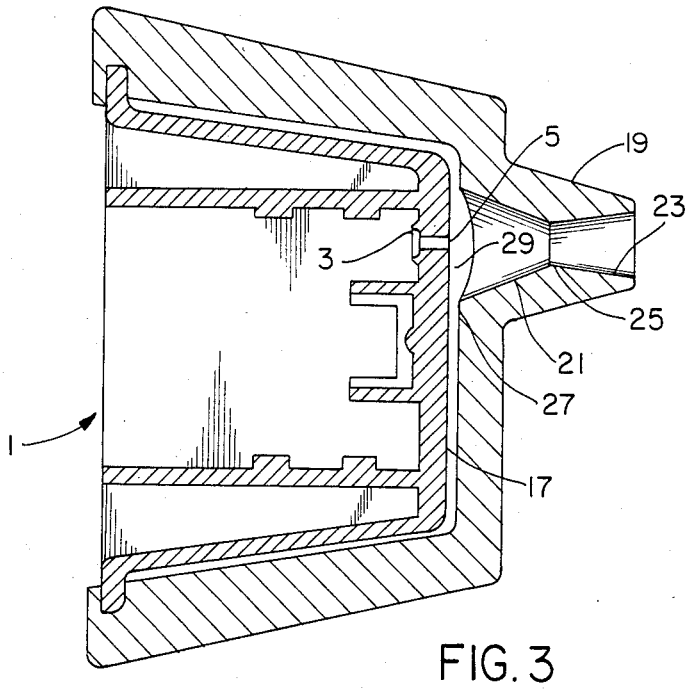
FIG. 3 of the drawings represents in cross section means defining a venturi opening in combination with the spray nozzle of FIG. 1.

FIG. 3 of the drawings illustrates in cross section means defining a venturi opening 19 in communication with spray nozzle 1. As illustrated in FIG. 3 of the drawings, the venturi opening comprises a first conical cavity 21 converging away from orifice 5 and merging with a second conical cavity 23 diverging away from the point of intersection 25.

It should be noted as a crucial feature of this invention that the point of beginning of the venturi opening 27 is spaced from partition 7 so that a space 29 exists between the two to provide for circumferential gaseous communication with liquid emerging from orifice 5.

Figure 4B:
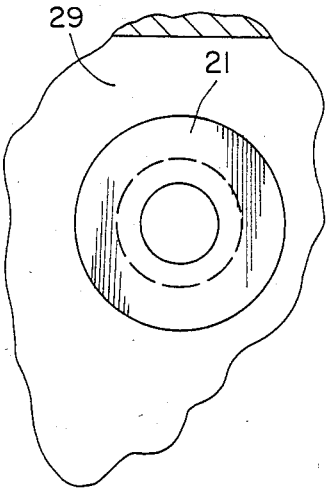
FIGS. 4A and 4B are enlarged views of a portion of the cross section of FIG. 3.
Figure 4A:
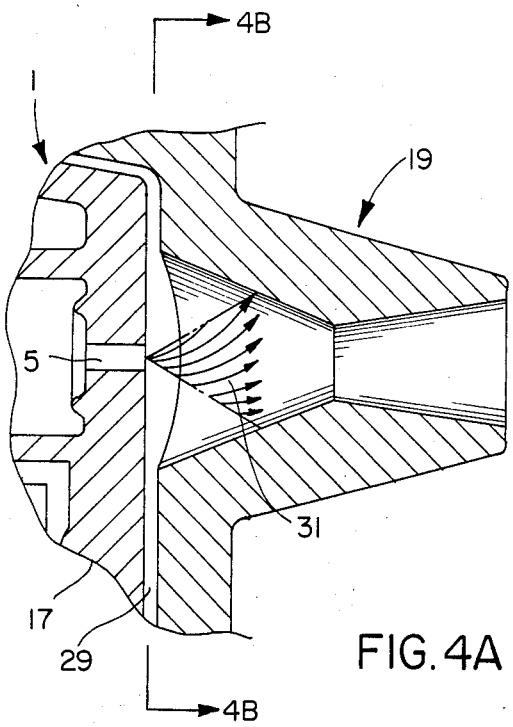

This aspect of the invention is best illustrated in FIGS. 4A and 4B wherein FIG. 4A is an enlargement of a portion of the view of FIG. 3, and FIG. 4B is a partial view along the line 4B of FIG. 4A. It is seen that space 29 is in circumferential communication with the entire area between partition 7 and the beginning of the venturi opening 27.

FIG. 4A also illustrates in shadow the flow of a liquid through orifice 5 and into first conical cavity 21 of the means for defining a venturi opening 19. The swirling flow is herein indicated at 31. It is thus seen that the swirling flow is vortexlike and entrains air through space 29, not only due to the cyclonic action of the swirl, but also, due to the venturi action brought about by flow through the means for defining a venturi opening 19. In both events the circumferential gaseous communication is necessary to achieve the entrainment due to the two effects.

As used herein, the terms "venturi" and "venturi opening" mean any constriction in a passageway which causes a reduced pressure due to flow through such constriction. The means for defining a venturi opening 19 in accordance with this invention may thus define openings of different configuration from those illustrated herein.

Figure 5:
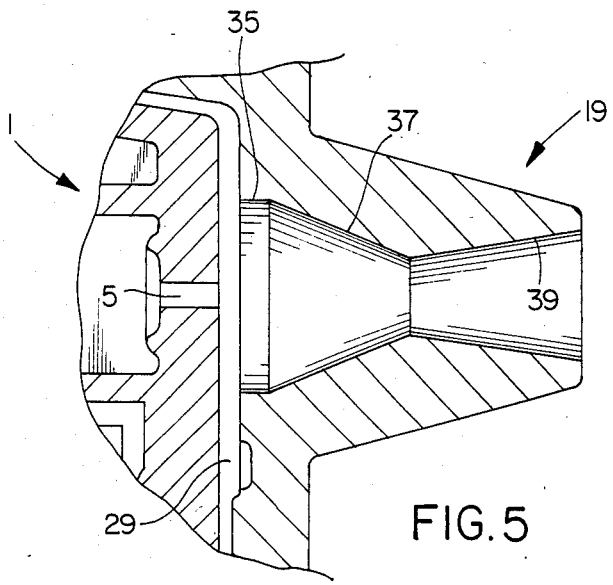
FIG. 5 is a cross section of an alternative embodiment in accordance with this invention.
Figure 6:
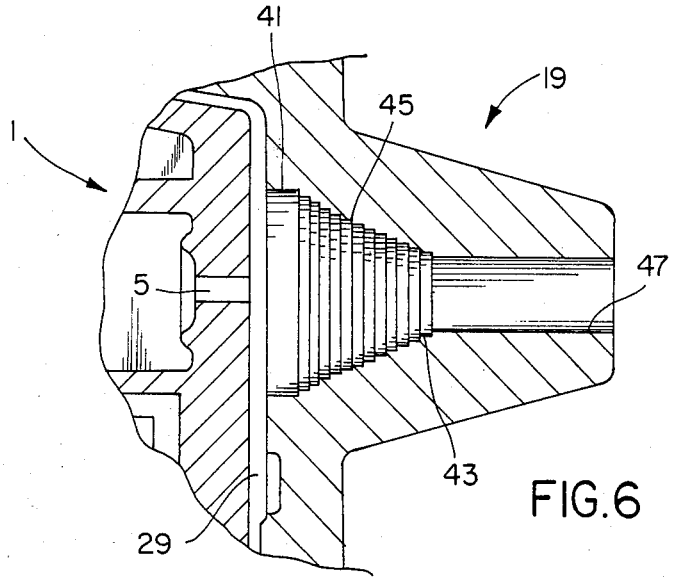
FIG. 6 is a cross section of an alternative embodiment in accordance with this invention.

For example, FIGS. 5 and 6 illustrate differing embodiments in accordance with this invention. For example, the venturi opening may be preceded with a generally cylindrical passageway 35 communicating with converging conical cavity 37. Conical section 37 intersects a second cylindrical section 39 to form the terminal portion of the means for defining a venturi opening.

FIG. 6 of the drawings illustrates a preferred construction in accordance with this invention and illustrates an aspect which has unexpectedly increased the foaming capability of the apparatus. The means for forming the venturi opening 19 defines a conical opening 41 in communication with a converging cone 43. The surface of the defined cone is roughened as illustrated by steps 45. The roughening of this conical section unexpectedly and for apparently unexplainable reasons increases the foaming capacity of the apparatus. Conical section 43 then communicates with a second cylindrical section 47 to define the termination of the venturi opening. The roughening at 47 may be a washboard type effect, or it may be simply stepped or spirally stepped, or as a further alternative, having a plurality of protuberances such as a sandpaper type roughening.

Figure 7:
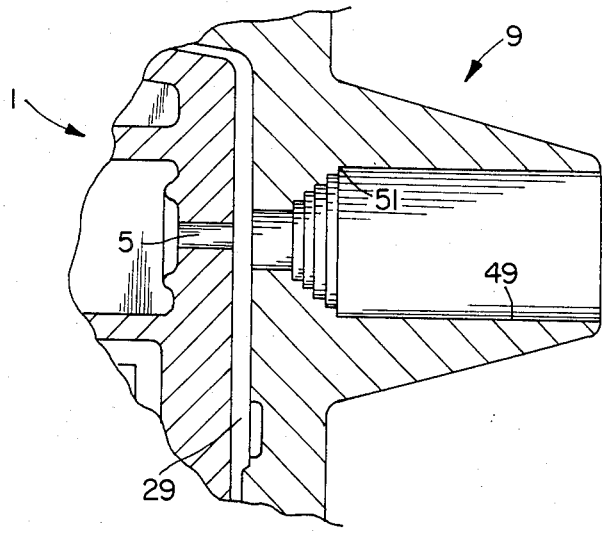
FIG. 7 is a cross section of an alternative embodiment in accordance with this invention.

FIG. 7 of the drawings illustrates yet another embodiment wherein the swirling liquid communicates with a space 29 of circumferential gas entrainment and then enters a cylindrical section 49 and then a stepped diverging conical section 51 prior to entering a second cylindrical section 53 for the determination of the means for defining a venturi. It has been found that having as initial diverging conical section as opposed to a converging conical section produces a wetter foam, but the stepped roughened surface produces a more effective foaming process than a corresponding use of a smooth conical surface.

Figure 8:
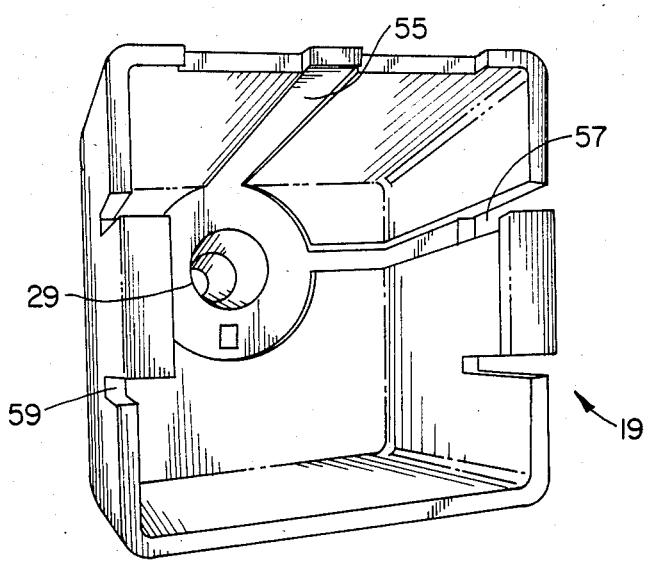
FIG. 8 is a perspective view of the interior of means defining a venturi opening of the type illustrated in cross section in FIG. 3.

FIG. 8 of the drawings shows in a perspective view the interior of means 19 defining a venturi opening. It is seen that means 19 fits an almost hand-in-glove relationship to nozzle 1 illustrated in FIG. 1 of the drawings. The hand-in-glove relationship illustrated in FIG. 3. A particular note in the construction illustrated in FIG. 8 is the space 29 which provides for the circumferential gaseous communication with a swirl of flowing liquid. It is seen that passageways 55, 57 and 59 are provided to communicate with the space 29.

Figure 9:
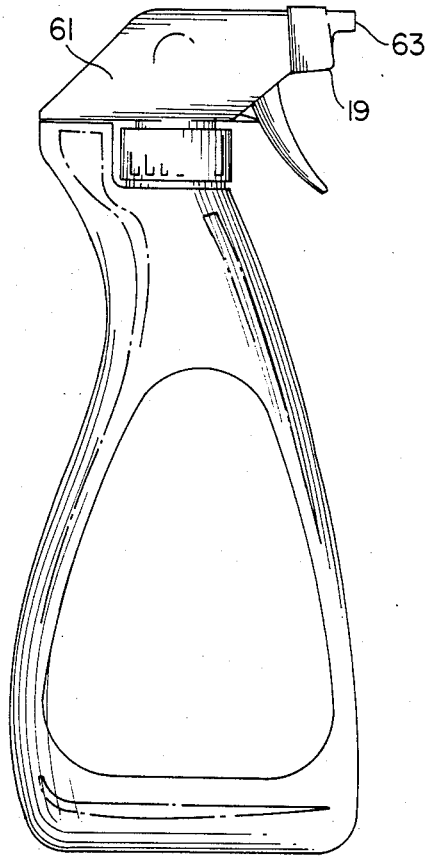
FIG. 9 of the drawings represents an entire apparatus for pumping and producing a foamed product.

FIG. 9 of the drawings shows an entire apparatus for pumping and producing a foamed product. The relationship of the components to one another are such that the container herein illustrated is a one pint container approximately nine (9) inches in overall height to the top of the pump mechanism illustrated herein at 61. Illustrated in the drawing is means 19 for defining a venturi opening as it covers spraying nozzle 1 therebeneath. For purposes of comparison, the overall length of the means 19 which envelopes the spray nozzle 1 is approximately 0.75 inches. The actual venturi opening itself which is contained within projection 63 including the circumferential space is approximately one-third (⅓) an inch or less. This is significantly less expansion space than utilized in prior art devices, and it has been surprisingly found that the device in accordance with this invention operates at significantly less pressure differential than prior art devices.

The foam producing apparatus in according with this invention is operable at an open nozzle pressure differential of 50–90 pounds per square inch, while prior art devices require approximately one-hundred and fifty (150) pounds per square inch pressure differential for operation. It is readily appreciated that this significantly reduces the manual force required to produce a foam.

While some general dimensions may be given for utilization with the apparatus for use in the process of this invention, it should be noted that optimum results will require tailored dimensions depending on the surface tension of the liquid product, the viscosity of the product, the density of the product, and the properties of the gas to be entrained. In general for detergent products, however, a nozzle opening of 0.10 inches with a divergence to 0.15 inches may be utilized. Convergence and divergence of the surfaces may be within the range of 15°–35° from horizontal.

It is thus seen that the foam generating apparatus and the process of its operation in accordance with this invention provides a novel process and apparatus for the production of foam. The process is carried out at substantially less pressure differential than required by prior art devices and utilizing significantly less space for foam production.

As many variations will be apparent to those in the art from reading the above detailed description, such variations are within the spirit and scope of this invention as defined by the following appended claims.

What is claimed is:

1. A foam generating apparatus, comprising:

means defining a swirl chamber;

a partition defining an orifice in communication with said swirl chamber;

means defining a venturi opening in communication with said orifice; and wherein said means defining a venturi opening is spaced from said partition so as to provide an area of substantially circumferential gaseous communication to liquid sprayed through said orifice and into said venturi opening; and wherein the travel distance for the sprayed liquid through said area of substantially circumferential gaseous communication and through said means defining a venturi opening is one-third (⅓) of an inch or less whereby liquid passes through said swirl chamber and said orifice to emerge therefrom as a fine mist spray and to entrain gas within said area of substantially circumferential gaseous communication both from venturi action and cyclonic action to emerge from said means defining a venturi opening as a foam within said less than one-third (⅓) inch distance of travel.

2. The foam generating apparatus in accordance with claim 1 wherein said means defining a venturi opening defines a first conical cavity converging away from said orifice and a second conical cavity communicating with said first conical cavity and diverging away from said orifice.

3. The foam generating apparatus in accordance with claim 1 wherein said means defining a venturi opening defines a first conical cavity converging away from said orifice and a cylindrical exit port communicating with said conical cavity.

4. The foam generating apparatus in accordance with claim 3 wherein said first conical cavity is defined with a roughened surface.

5. The foam generating apparatus in accordance with claim 4 wherein said roughened surface is stepped.

6. The foam generating apparatus in accordance with claim 4 wherein said roughened surface is step spiraled.

7. A process for producing a foam spray, comprising:

passing a foamable liquid through a swirl chamber and orifice smaller than said swirl chamber at a pressure differential of less than 90 p.s.i. to produce a vortex fine mist spray to emerge from said orifice;

passing said vortex fine mist spray into a venturi opening and wherein said vortex fine mist spray passes through a circumferential area of a gaseous communication whereby gas is drawn into said vortex fine mist spray by venturi action and cyclonic action within said circumferential area to produce a gaseous mixture with said liquid which will foam within approximately one-third (⅓) of an inch from said area of circumferential area of gaseous communication; and passing said mixture through a nozzle opening to emerge as a foam product created by the mixing of said gas and said foamable liquid.

* * * * *